US006134817A

United States Patent [19]

Fourny et al.

[11] Patent Number: 6,134,817

[45] Date of Patent: Oct. 24, 2000

[54] SOLEPLATE FOR AN IRON

[75] Inventors: Jacky Rene Paul Fourny, Berus; Christian Diore, Saint-Germain-du-Corbeis, both of France

[73] Assignee: Moulinex S.A., Paris, France

[21] Appl. No.: 09/101,814

[22] PCT Filed: Jan. 13, 1997

[86] PCT No.: PCT/FR97/00053

§ 371 Date: Nov. 5, 1998

§ 102(e) Date: Nov. 5, 1998

[87] PCT Pub. No.: WO97/26399

PCT Pub. Date: Jul. 24, 1997

[30] Foreign Application Priority Data

Jan. 17, 1996 [FR] France ..... 96 00498

[51] Int. Cl.[7] ..... D06F 75/38

[52] U.S. Cl. ..... 38/93

[58] Field of Search ..... 38/93, 87, 88, 38/97, 94, 80, 81; 156/295

[56] References Cited

U.S. PATENT DOCUMENTS

| | | | |
|---|---|---|---|
| 863,861 | 8/1907 | Lucas | 38/97 |
| 1,963,858 | 6/1934 | Meidell | 38/97 |
| 2,142,032 | 12/1938 | Matsen | 38/97 X |
| 2,299,322 | 10/1942 | Harter | 38/97 X |
| 2,846,793 | 8/1958 | Studer | 38/93 X |
| 3,783,538 | 1/1974 | Von Arnim | 38/97 |
| 4,822,686 | 4/1989 | Louison et al. | 38/97 X |

FOREIGN PATENT DOCUMENTS

| | | | |
|---|---|---|---|
| 0 556 721 | 8/1993 | European Pat. Off. . | |
| 390 606 | 2/1924 | Germany . | |
| 1 939 634 | 6/1966 | Germany . | |
| 295 05 735 U | 5/1995 | Germany . | |
| 6 439 | 11/1910 | United Kingdom . | |
| 2 225 345 | 5/1990 | United Kingdom . | |
| 018372 | 8/1994 | WIPO | 38/93 |

*Primary Examiner*—Ismael Izaguirre
*Attorney, Agent, or Firm*—Young & Thompson

[57] ABSTRACT

A soleplate for an iron comprising a cast heating body (1) with an outer edge (4) having a tip (6) and a heel (8), as well as a metal ironing plate (10) having a matching shape and including a pointed front portion (12) and a rear portion (14), and comprising an inner surface (16), an outer surface (20) coated with a coating (22) and a rim (24) arranged around the side of the outer edge (4) of the heating body and provided with elements for attaching it thereto. The elements for attaching the rim (24) comprise a preformed curled edge (26) for capping the tip (6) at least in the front portion (12), and at least one hook (28) for engaging the heel (8) in the rear portion (14).

9 Claims, 4 Drawing Sheets

SOLEPLATE FOR AN IRON

CROSS REFERENCE TO RELATED APPLICATION

This is the 35 USC 371 of International application PCT/FR97/00053 filed on Jan. 13, 1997, which designated the United States of America.

FIELD OF THE INVENTION

The invention relates to a soleplate for an iron comprising a heating body made by casting and having a peripheral edge of triangular profile defining a nose and a heel, as well as a metallic ironing plate of complementary shape having a pointed forward region and a rear region matching the heel, and which comprises an internal surface adapted to come into thermal contact with the internal surface of the heating body, an external surface having a cladding to form an ironing surface, and a raised edge which surrounds laterally the peripheral edge of the heating body and which comprises assembly means with said edge.

BACKGROUND OF THE INVENTION

In known soleplates for irons of this type, the cladding of the external surface of the ironing plate is relatively fragile, which is to say that it resists only poorly mechanical stresses inflicted during assembly of the plate on the body; this is all the more true when the cladding is of the enamel or chrome type.

Thus, for example, in the case of assembly of the edge on the body, there is created at the level of the bend microcracks which not only impair the appearance but also give rise eventually to oxidation which spreads over the ironing surface.

Moreover, there are also known soleplates for irons in which the ironing plate is fixed by resilient snapping on the heating body.

Although this solution overcomes the problem of microcracks, it requires precise fabrication to provide for assembly, during molding of the heating body, which prevents mass production.

The invention has particularly for its object to overcome these drawbacks.

SUMMARY OF THE INVENTION

According to the invention, the assembly means of the edge comprise at least in the forward region of the edge a preformed and rolled edge adapted to cap the point of the heating body, and in its rear region at least one hook adapted to come into engagement with the heel of the edge of the heating body.

Thus, starting from a plate whose edge is preformed and rolled before depositing the cladding and by limiting the force on the edge solely to the end regions of the ironing plate, regions which are particularly rigid because they are practically points, there is created a simple and economical soleplate adapted for mass production and which preserves for the plate the quality of its cladding without alteration in the course of time.

BRIEF DESCRIPTION OF THE DRAWINGS

The characteristics and advantages of the invention will become further apparent from the description which follows, by way of example, with reference to the accompanying drawings, in which.

DETAILED DESCRIPTION OF THE INVENTION

Figure 1:
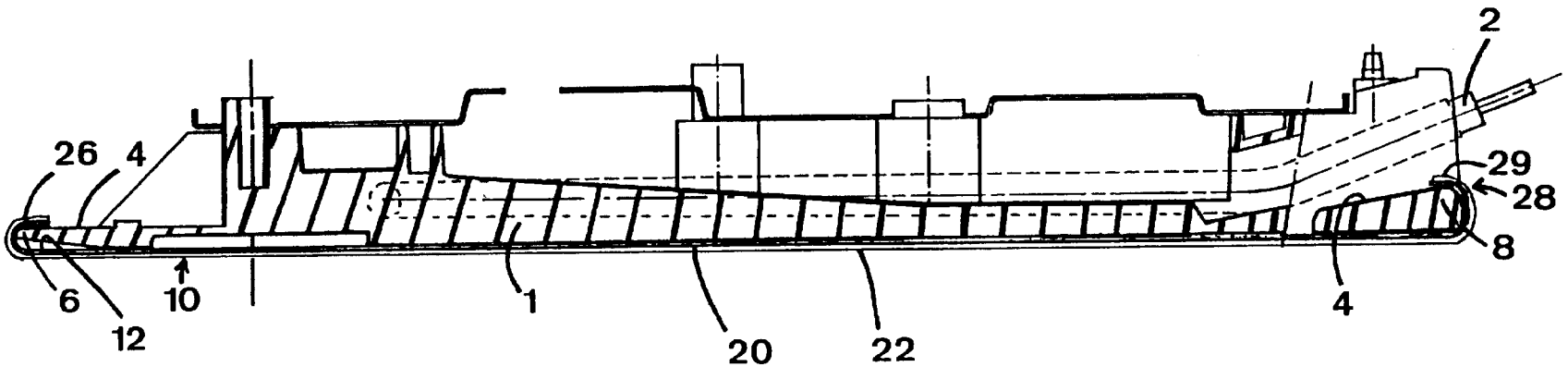
FIG. 1 is a schematic vertical cross-sectional view on the broken line I—I of FIG. 2, of a soleplate according to the invention comprising a heating body and an ironing plate.

The soleplate for an iron, as shown in FIGS. 1 to 4, comprises a heating body 1 made by casting, generally molded in one piece from aluminum and comprising a shielded electric resistance 2. As shown particularly in FIG. 2, the heating body 1 has a peripheral edge 4 with a generally triangular profile defining a nose 6 and a heel 8. This peripheral edge 4 is substantially flat and has a relatively small and regular thickness except in its heel portion, which is slightly thicker.

The soleplate comprises moreover a metallic ironing plate 10 of a shape complementary to the profile of the heating body 1 and thus having a forward pointed region 12 and a rear region 14 forming a heel. The plate comprises an internal surface 16 adapted to come into thermal contact with the lower surface 18 of the heating body, and an external surface 20 clad with a cladding 22 to constitute an ironing surface, and a raised edge 24 which surrounds in height the peripheral edge 4 of the heating body 1 and which comprises assembly means with said edge.

This plate 10 is preferably of steel and the cladding 22 of the plate 10 is constituted for example by a layer of enamel or chrome which ensures very good sliding of the soleplate on different textiles.

Figure 3:
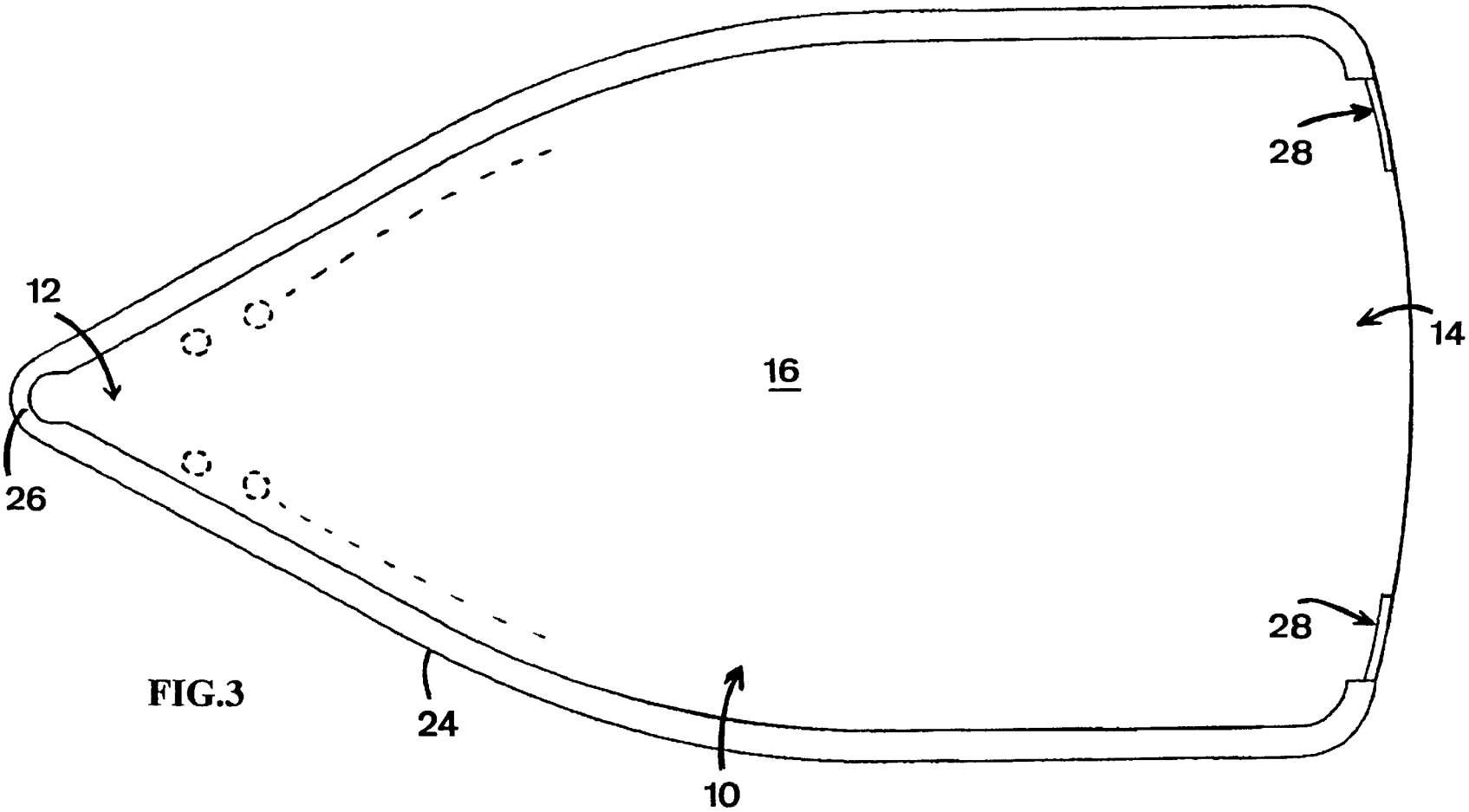
FIG. 3 shows in plan view the ironing plate alone.
Figure 4:
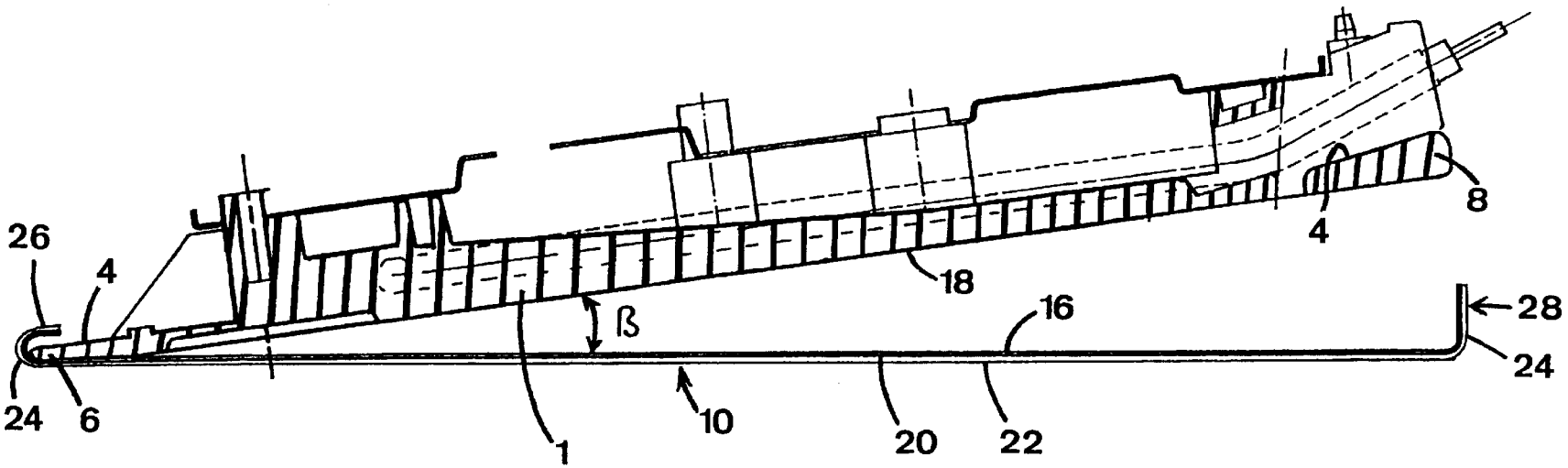
FIG. 4 shows the heating body and the ironing plate in one phase of assembly of the soleplate according to the invention.

This soleplate thus constituted can be used either in an iron of the dry type, or a steam iron in which the plate 10 has, in a manner known per se, a plurality of outlet holes for steam as schematically shown in broken lines in FIG. 3.

Moreover, so as to ensure excellent heat exchange between the lower surface 18 of the heating body 1 and the internal surface 16 of the plate, there is applied to the lower surface 18 a layer of silicone cement.

According to the invention, the assembly means for the edge 24 comprise at least in the forward region 12 of the edge a preformed and rolled edge 26 adapted to cap the point 6 of the heating body and in the rear region 14 at least one hook 28 adapted to come into engagement with the heel 8 of the edge 4 of the heating body.

Figure 2:
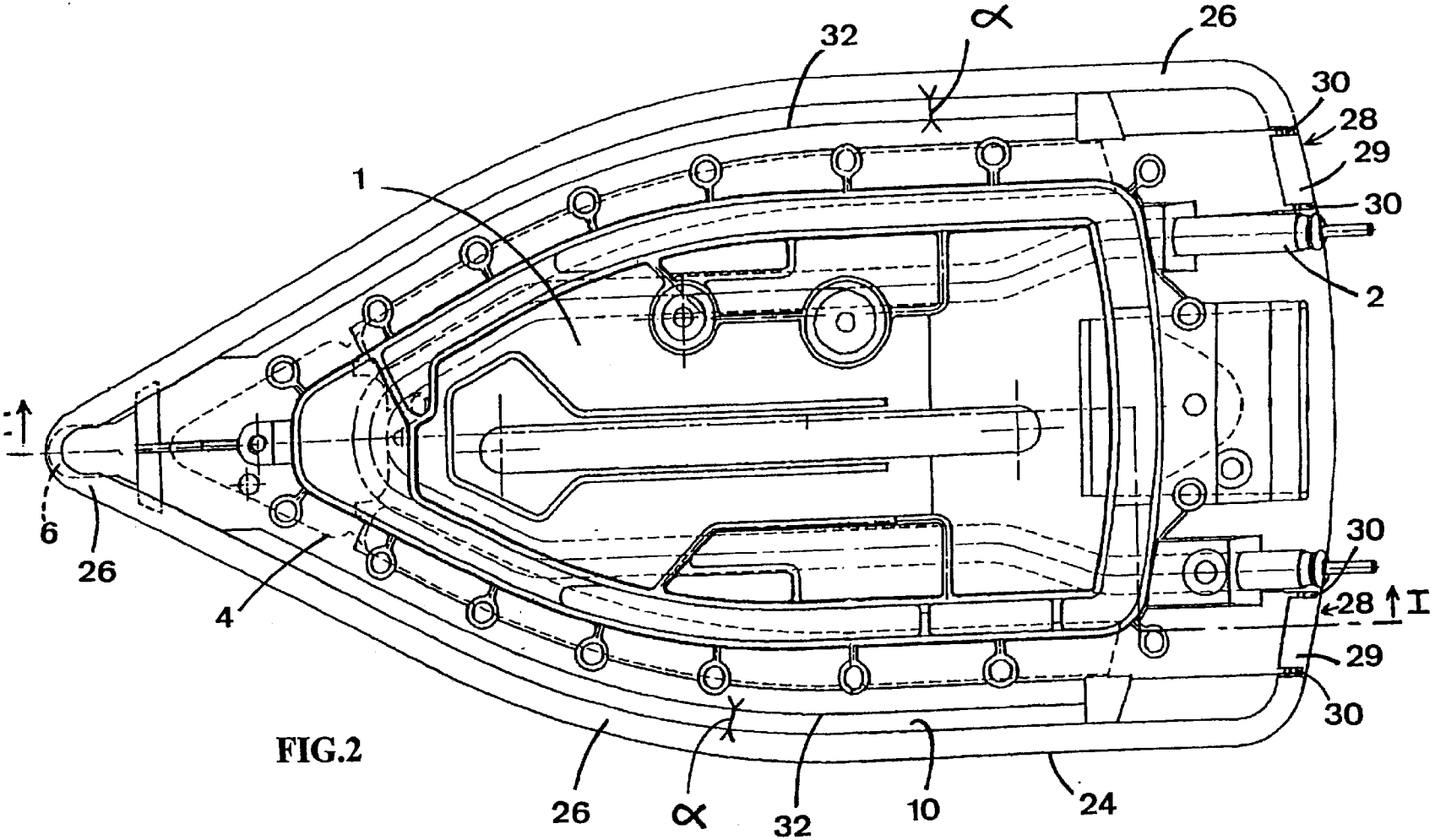
FIG. 2 shows in plan view the soleplate of FIG. 1.

In a preferred embodiment and so as to guarantee better hooking of the plate, this latter comprises two hooks 28 as shown in FIG. 2.

As will be seen, each hook 28 comprises a tongue of which a portion 29 is bent in the direction of the central region of the heating body 1. Preferably, these hooks are obtained by recesses 30 provided in the edge 24 so as to permit bending the portions 29 of the tongues.

In another embodiment (not shown), the hook 28 is a resilient element adapted to snap automatically onto the heel, this resilient element being adapted to be a tongue made from the edge 24 and having a lateral boss forming a clip.

Thus, thanks to the invention, the plate 10 preliminarily shaped and clad with a fragile cladding, enamel or chrome, is fixed to the peripheral edge 4 of the heating body at its ends, point and heel, without damaging the cladding of the edge 24 and hence the cladding of the ironing surface.

It will be understood that the preformed and rolled edge 26 in the vicinity of the point has, because of its triangular shape with an acute angle constituting a pocket, a rigidity which prevents any deformation of the edge and hence any local elongation of the cladding, and hence avoids the creation of microcracks. Similarly, the forces exerted on the hooks 28 are very localized and are exerted only on the horizontal portions 29 of the tongues which, at the end of production of the iron, will be hidden by the housing.

According to a particularly interesting characteristic of the invention illustrated in FIGS. 2 and 3, a rolled edge 26 of the edge 24 extends also laterally of the large lateral edges 32 of the heating body, and at a distance from these edges with a slight play α. Thus, there is avoided a precise adjustment of the edges of the heating body and of the edge, which would be difficult to achieve, particularly during the operation of casting the heating body.

On the other hand, thanks to this play, the direct transmission of heat from the peripheral edge 4 to the edge 24 is reduced, thereby minimizing burns to the user by lateral contact with said edge of the soleplate.

Referring to FIG. 1, there will be explained a preferred process for the production of a soleplate by assembly of the ironing plate 10 on the heating body 1; said plate 10 having first been shaped with its edge rolled, then covered over all the external surface 20 with a fragile cladding.

In a first phase, the plate 10 thus finished and the heating body 1 are maintained at an angle β. Then the point 6 of the edge 4 is inserted below the rolled edge 26 of the forward region of the edge 24. Then the lower surface 18 and internal surface 16, respectively of the heating body 1 and of the plate 10, are applied against each other and the assembly thus produced is maintained by emplacing the hooks 28 on the heel 8. This emplacement of the hooks takes place by bending of the portions 29 on the heel 8. This securement about the pivoting point formed by the point 6 and the rolled edge 26 permits a substantially intimate application of the layer of silicone cement with the lower surface 18 of the heating body because the force of application is controlled at the level of the hooks 28.

Moreover, this process offers as its principal advantages the simplicity of production, and the guarantee of the quality of the surface of the iron not only during production but also during long-term usage.

What is claimed is:

1. Soleplate for an iron comprising:

a heating body made by casting and having a peripheral edge of a generally triangular profile defining a point and a heel; said heating body having a central region, and a lower surface;

a metallic pressing plate having a shape complementary to that of the heating body; said pressing plate having a pointed forward region, a rear region, an internal surface adapted to come into terminal contact with the lower surface of the heating body, an external surface clad with a fragile cladding to constitute an ironing surface, and a raised edge which surrounds laterally the peripheral edge of the heating body and which comprises assembly means with said peripheral edge; and wherein the assembly means of the raised edge comprise in the pointed forward region of the pressing plate, a preformed and rolled edge adapted to cap the point of the heating body, and in its rear region at least one hook adapted to come into engagement with the heel of the peripheral edge of the heating body.

2. Soleplate for an iron according to claim 1, wherein the hook comprises a tongue having one portion which is bent in the direction of the central region of the heating body.

3. Soleplate for an iron according to claim 1, wherein the hook is a resilient element adapted to snap automatically onto the heel.

4. Soleplate for an iron according to claim 1, wherein the preformed and rolled edge also extends laterally to large lateral edges of the heating body.

5. Soleplate for an iron according to claim 4, wherein the preformed and rolled edge extends at a distance from the lateral edges with a slight play.

6. Soleplate for an iron according to claim 1, wherein the lower surface of the heating body has a layer of silicon cement applied thereon.

7. Soleplate for an iron according to claim 1, wherein the cladding is formed by a layer of chrome.

8. Soleplate for an iron according to claim 1, wherein the cladding is a layer of enamel.

9. Process for producing a soleplate for an iron, which comprises:

providing a heating body made by casting and having a peripheral edge of a generally triangular profile defining a point, a heel, and a lower surface;

shaping a metallic pressing plate in a shape complementary to that of the heating body; the shaped metallic pressing plate having a pointed forward region, a rear region, an internal surface adapted to come into terminal contact with the lower surface of the heating body, an external surface clad with a fragile cladding to constitute an ironing surface, and a raised edge which comprises assembly means for assembling with the peripheral edge; said assembly means comprising in the pointed forward region a preformed and rolled edge adapted to cap the point of the heating body, and in its rear region at least one hook adapted to come into engagement with the heel of the peripheral edge of the heating body;

maintaining the metallic pressing plate and the heating body at an angle β;

inserting the point of the peripheral edge below the rolled edge of the pointed forward region of the raised edge;

applying the lower surface of the heating body and an internal surface of the plate against each other to obtain an assembled unit; and maintaining the assembled unit by emplacing the hook on the heel.

* * * * *